US006273502B1

(12) United States Patent
Lo

(10) Patent No.: US 6,273,502 B1
(45) Date of Patent: Aug. 14, 2001

(54) ERGONOMICALLY DESIGNED CHAIR WITH ADJUSTABLE KEYPAD SUPPORT ARRANGEMENT

(76) Inventor: Peter Yin-Guan Lo, 4311 Maryland Ave., Bethesda, MD (US) 20816-2515

( * ) Notice: Subject to any disclaimer, the term of this patent is extended or adjusted under 35 U.S.C. 154(b) by 0 days.

(21) Appl. No.: 09/577,483

(22) Filed: May 25, 2000

(51) Int. Cl.[7] ..... A47B 39/00
(52) U.S. Cl. ..... 297/145; 297/188.16
(58) Field of Search ..... 297/135, 145, 297/170, 173, 174, 188.01, 188.14, 188.15, 188.16, 188.21

(56) References Cited

U.S. PATENT DOCUMENTS

| | | | |
|---|---|---|---|
| 1,888,525 | * | 11/1932 | Callaway et al. . |
| 2,518,381 | * | 8/1950 | Runkles . |
| 2,741,300 | * | 4/1956 | Tubbs et al. . |
| 2,845,113 | | 7/1958 | Keel . |
| 2,947,348 | | 8/1960 | Peckham . |
| 4,834,449 | * | 5/1989 | Engelman . |
| 4,852,940 | | 8/1989 | Kanigowski . |
| 5,022,706 | | 6/1991 | Bryan . |
| 5,217,277 | * | 6/1993 | Rasnick et al. . |
| 5,547,247 | | 8/1996 | Dixon . |
| 5,630,642 | * | 5/1997 | Grimmett et al. . |
| 5,653,499 | | 8/1997 | Goodall . |

FOREIGN PATENT DOCUMENTS

| | | | |
|---|---|---|---|
| 470700 | * | 8/1937 | (GB) . |
| 519988 | * | 4/1940 | (GB) . |

* cited by examiner

*Primary Examiner*—Milton Nelson, Jr.
(74) *Attorney, Agent, or Firm*—Larson & Taylor, PLC

(57) ABSTRACT

An ergonomically designed chair having a keyboard support arrangement which is adjustable to suit the needs of individual workers, and which may be stored within the armrests of the chair when the keyboard is not in use. The support arrangement provides a position adjustment capability for a keyboard supported thereby and also enables the keyboard to be swung to one side so as to afford a user convenient entry to and exit from the chair. The chair has a seat and a pair of armrests, each including a compartment therein. Each compartment includes a compartment door, a vertical support member disposed in the compartment, and a multi-link extendable support arm. The multi-link arm is rotatable at one end about the support member for movement, when the door is open, between a storage position within the compartment and a support position outside of the compartment. One of the compartments is used to store a keyboard support frame for, in use, supporting a computer keyboard. The support arms, when in the support position, are extendable to support the keyboard support frame therebetween at a desired location relative to the chair.

20 Claims, 5 Drawing Sheets

ERGONOMICALLY DESIGNED CHAIR WITH ADJUSTABLE KEYPAD SUPPORT ARRANGEMENT

BACKGROUND OF THE INVENTION

1. Field of the Invention

The present invention relates to an ergonomically designed chair for, inter alia, enabling convenient use of the latest wireless computer keyboard technology. More particularly, the present invention relates to an ergonomically designed chair having a keyboard support arrangement that is adjustable to individual workers, and which may be stored within the armrests of the chair when the keyboard is not in use.

2. Background of the Invention

With the recent arrival of "the information age," the need has increased for workers in many fields to use computers to assist them in widely differing types of work. Not only have the numbers of workers using computers greatly increased, the amount of time a typical worker spends per day using a computer has greatly increased as well. Therefore, issues relating to worker comfort have taken on much greater importance. This is particularly true of the issue of prevention of long term injury to workers from radiation, especially to the eyes, from computer monitors, and wrist and arm strains such as carpal tunnel syndrome from repeated keyboard use.

Another trend in computer use has been towards two or more workers sharing the same computer. This is especially true of businesses having 24 hour operations, such as technical support or customer service, or international operations spanning differing time zones. The same computer may be used by several people on different shifts to avoid the waste of buying unnecessary computers. This has created additional comfort issues for workers of differing sizes and shapes using the same workstations with fixed keyboard adjustments.

Further, with the advent of wireless keyboard technology, the keyboard operator has been freed from the necessity of being in close proximity to his or her computer and monitor when giving keyboard commands. As a consequence, separate support arrangements divorced from the usual desk setup for the computer keyboard are useful in many environments and considerations such as space savings and aesthetic appearance make keyboard support arrangements that can be stowed out of sight increasingly attractive. Of course, with a common pair of keyboard and mouse extension cables, a non-wireless keyboard and mouse can also be used with the present invention as described below.

There have been attempts in the prior art to address some of these issues. For example, U.S. Pat. No. 5,022,706 to Bryan discloses a chair with vertically adjustable arms and foldable support tables on which a keyboard may be placed. The adjustment mechanism in the Bryan patent is such that the keyboard can only be adjusted in a vertical direction, which is not always sufficient to allow a user to locate the keyboard in a comfortable position. Further, the twin support tables do not provide support to the entire keyboard, so that the keyboard is in some danger of sliding or falling off the small supports. In addition, the keyboard must be removed whenever the user wishes to leave the chair, which can be a time consuming and awkward task, and increases the risk of damage to the keyboard.

Therefore, there is a need in the art for a chair that includes a stowable keyboard support arrangement and which is capable of independently supporting a computer keyboard while providing a wide range of adjustment of the keyboard location to suit the needs of each individual user.

SUMMARY OF THE INVENTION

In accordance with the invention, an ergonomically designed chair is provided which includes a stowable computer keyboard support arrangement that affords a wide range of adjustment of the keyboard location to suit the individual needs of each user. The support arrangement fully supports the keyboard while also enabling simple movement of the keyboard out of the way so as to permit convenient entry to and exit from the chair.

According to one aspect of the invention, a chair is provided that comprises a seat and a pair of armrests. Each armrest includes a compartment located therein, and each of the compartments includes a compartment door, a vertical support member disposed in the compartment, and a multi-link extendable support arm rotatable at one end about the support member for movement, when said door is open, between a storage position within the compartment and a support position outside of the compartment. One of the compartments also contains a keyboard support frame and means for storing said support frame within the compartment when the support frame is not in use. The support arms, when in the support position, are extendable to support the support frame therebetween at a desired location relative to the door. The support frame, when in use, is anchored to the support arms so as to support a computer keyboard.

Preferably, the keyboard is stored by using at least one support bracket located on an interior side wall of a door. Advantageously, the doors are located on the outer sides of the armrests and each armrest includes a hinge for mounting the associated door, so that the doors open rearwardly away from the front of the chair.

Preferably, an adjustable means is provided for mounting each of the multi-link support arms for vertical movement along the respective support member so that the arms can be vertically adjusted. The adjustable means include a plurality of vertically spaced slots in the vertical support member and a spring carried by each respective arm at the one end for releasably engaging a selected slot so as to retain the arm at a desired vertical height along the support member determined by the selected slot engaged by the spring.

Advantageously, the multi-link arm is comprised of three links. A first link is rotatable about the support member, and movable vertically therealong. A second link is pivotably connected to the first link and a third link is pivotably connected to the second link. Preferably, the multi-link arm is further comprised of two adjustable joints. A first adjustable joint pivotably connects the first and second links and a second adjustable joint for pivotably connects the second and third links. The joints each comprise a yoke end of one of the links and a rod end of another link, with the rod end being received in the yoke end, and a tightening means being provided for securing the yoke end and rod end together in a selected, fixed relation. Each multi-link arm further comprises an anchor element located on the free end of the third link for securing the keyboard support frame to the arm.

Advantageously, each of the compartments further comprises an opening, located at the front of the associated compartment, for enabling the respective arm to extend outside of the compartment in its support position when the compartment door is closed.

In preferred implementation, the keyboard support frame comprises a plurality of sliding rails that enable adjustment of the length and width of the keyboard frame. Advantageously, the sliding rails comprise two parallel sliding rails extending along the width of the frame, and three parallel sliding rails extending along the length of the frame. The center rail of the three parallel rails has first and second spaced openings therein for receiving an anchor element of a respective support arm, and one of the openings comprises an elongated slot. Preferably, the keyboard support frame further comprises ball bearings for providing a gliding action between the rails. Advantageously, means are provided for supporting a computer mouse at one end of the keyboard support frame.

Other features and advantages of the invention will be set forth in, or will be apparent from, the detailed description of a preferred embodiment which follows.

DESCRIPTION OF THE PREFERRED EMBODIMENTS

As indicated above, according to the present invention, there is provided an ergonomically designed chair which is capable of full position adjustment of the keyboard location for the individual needs and comfort of each user, and is further capable of fully supporting the keyboard while allowing simple movement of the keyboard for convenient entry to and exit from the chair.

Figure 1A:
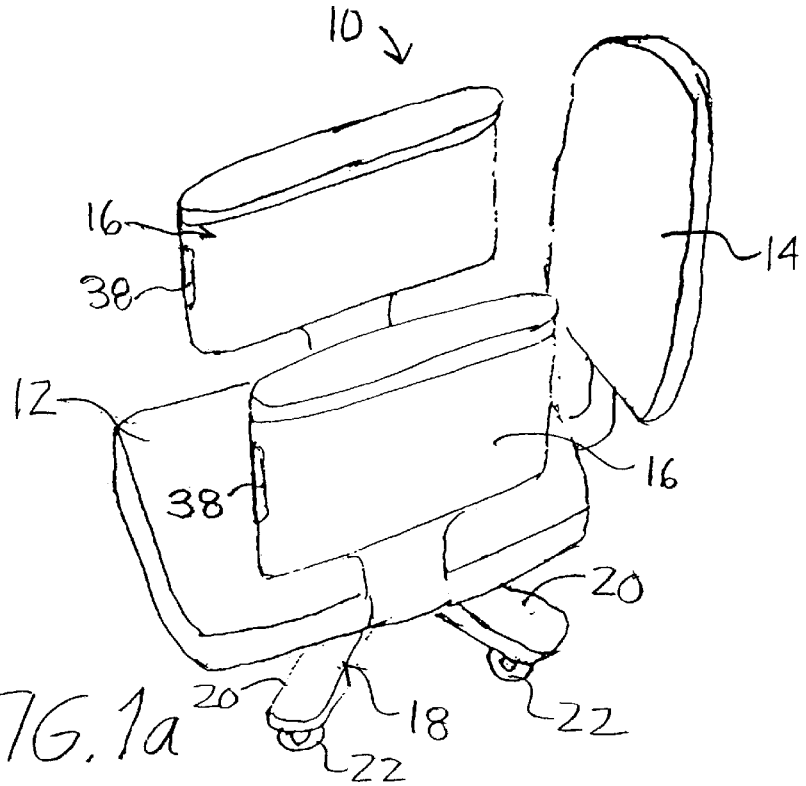
FIG. 1*a* is a perspective view of a chair constructed in accordance with a preferred embodiment of the invention with the associated compartment doors closed.
Figure 1B:
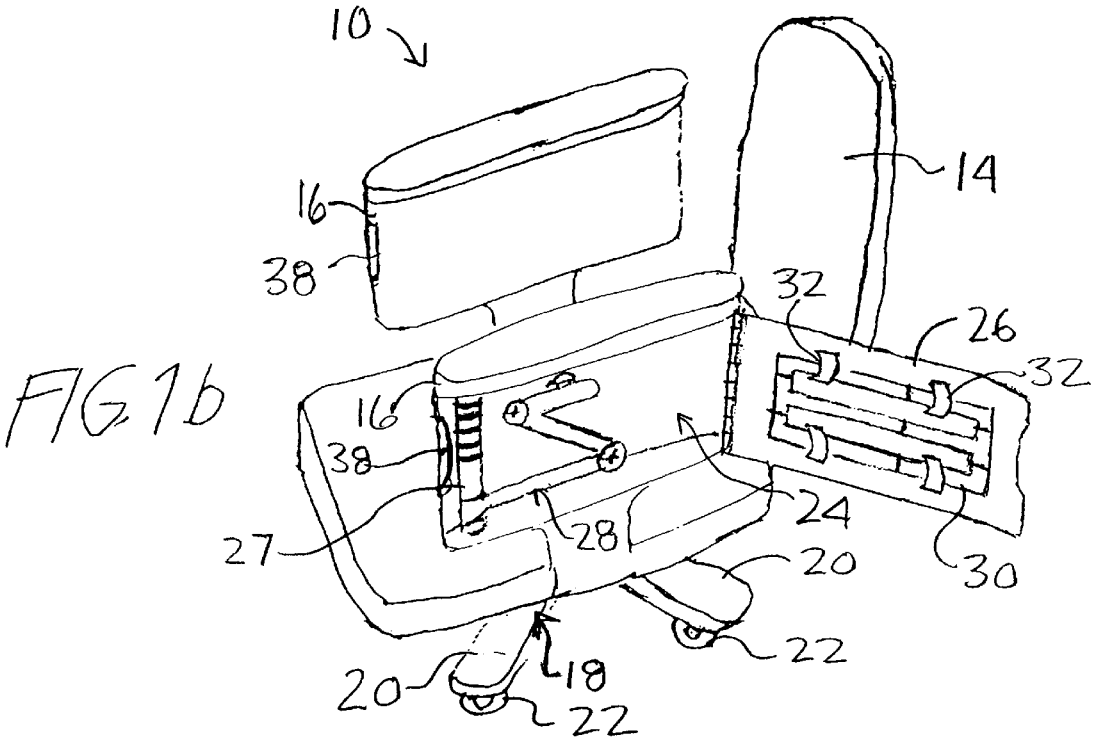
FIG. 1*b* is a perspective view similar to FIG. 1*a*, with one of the compartment doors open, exposing to view the keyboard support apparatus within the compartment.

A preferred embodiment of the integrated chair-keyboard support system will be discussed with reference the drawings, referring to FIGS. 1*a* and 1*b*, there is shown a chair 10 comprising a seat 12, a seatback 14 and a pair of armrests 16 which extend upwardly from the seat 12. In the illustrated embodiment, chair 10 further includes a base 18 including radially extending support legs 20 having casters 22 at the free ends thereof. It will be understood that the overall design of the chair can take different forms other than that specifically illustrated and a further, more detailed description of the overall chair construction will be dispensed with. As shown in FIG. 1*b*, for one of the armrests, each of the armrest includes a compartment 24 located therein. As described in more detail, each of the compartments 16 includes a compartment door 26, a vertical support member 27 disposed in the compartment 16, and a multi-link extendable support arm 28. The doors 26 are disposed at the outer sides of the respective armrests so as to open outwardly and rearwardly. When the door 26 is open, the support arm 28 can be rotated from a storage position within the compartment 16, which is the position shown in FIG. 1*b*, to a support position outside the compartment 16 as described in more detail below. One of the compartments 16, viz. the open compartment shown in FIG. 1*b*, additionally contains a keyboard support frame 30. In use, the keyboard support frame 30 supports a computer keyboard (not shown) as discussed below. The keyboard support frame 30 is stored in the compartment 16 when not in use.

Figure 2A:
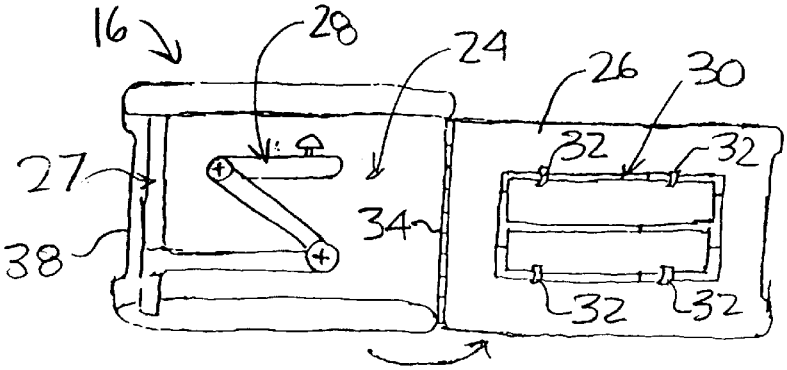
FIG. 2*a* is a side elevational view of a compartment of the chair of FIG. 1, showing the door open, and the multi-link arm and the keyboard support frame in stored position.

Turning to FIGS. 2*a* to 2*d*, and referring first to FIG. 2*a*, the door 26 is shown in the fully open position thereof, with the keyboard support frame 30 being stored using a plurality of spaced support brackets 32 mounted on an interior side wall of doors 26. As indicated above, the keyboard support frame 30 is hung on the support brackets 32 when not in use. As shown for armrest 16, each armrest 16 includes a vertical hinge 34 at the rear thereof for mounting the associated compartment door 26. The hinge 34 is conventional and is located at a rear part of the armrest so that the door 26 opens rearwardly away from the front of the chair 10, as indicated above.

Each of the multi-link arms 28 is rotatable at one end about the associated support member 27. When not in use, the multilink arm 28 rotated to a storage position which the arm faces rearwardly so as to be accommodated within the associated compartment 24 as shown in FIG. 2*a*.

Figure 2B:
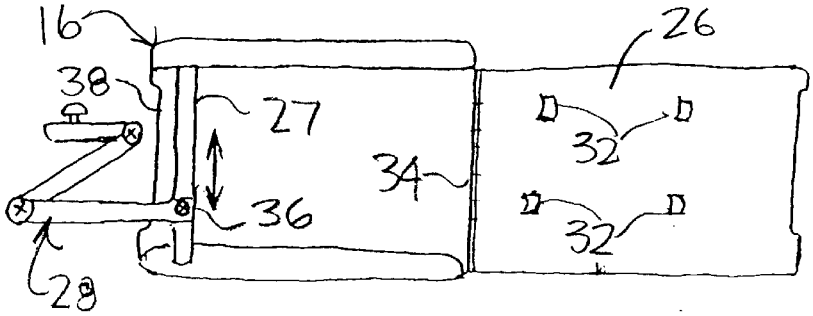
FIG. 2*b* is a side elevational view of the compartment of FIG. 2*a* showing the door open, the multi-link arm rotated towards the front of the chair in a support position, and the keyboard support frame removed for use.
Figure 2C:
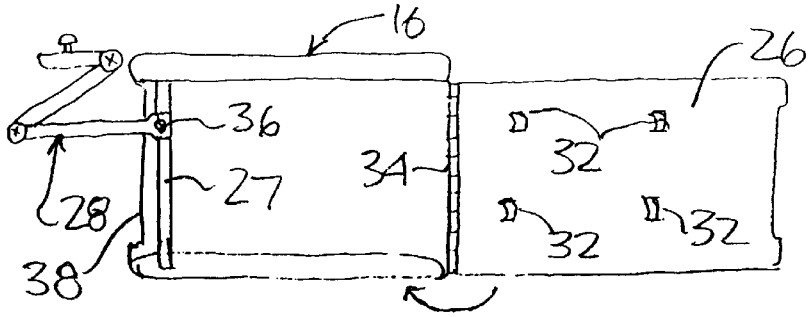
FIG. 2*c* is a side elevational view of the compartment of FIG. 2*a*, showing the multi-link arm moved vertically along the support member.

When the arms 28 are to be used, each arm 28 is rotated into a forwardly facing position outside of compartment 24 as shown in FIG. 2*b*. Arm 28 is then extended into a support position of choice as shown in FIG. 2*c*. As indicated by the double arrow A and is described in more detail below, arm 28 is also movable up and down along support member 27, when positioned at the desired position along support member 27.

Figure 2D:
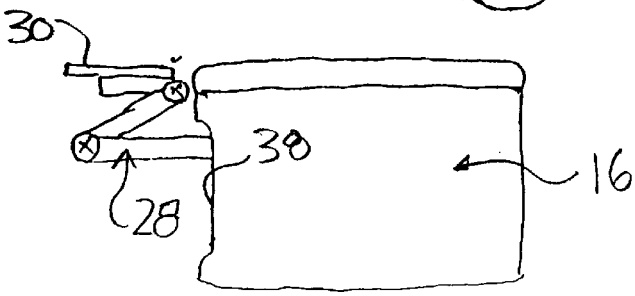
FIG. 2*d* is a side elevational view of the compartment of FIG. 2*a*, showing the door closed, the multilink support arm extending through an opening in the front of the compartment and in a support position, and the keyboard support member supporting the keyboard.

When the arms 28 are both extended into the desired support position, the keyboard support frame 30 supported between both arms 28 as shown in FIG. 2*d*, and anchored thereupon at a desired location relative to the chair. Although the multi-link arm 28 is shown as having the same basic final combination in FIG. 2*b* as in FIGS. 2*b* to 2*c*, it will be understood that the arms 28 are extendible and thus the height of the support frame 30 and the spacing thereof from chair 10 can be adjusted as desired by the user.

As indicated at 36, an adjustment device is located at the point where each multi-link arm 28 is mounted to the associated support member 27. The adjustment device 36 permits vertical movement of the corresponding arm 28 along its associated support member 27 and, in particular, the vertical adjustment of the arms 28 permits vertical adjustment of the support member 30 as a whole by the user. As indicated in FIG. 2*b*, after the arms 28 are adjusted so as to assume the desired position and the keyboard support frame 30 has been removed from storage and placed between the arms 28, the doors 26 of the respective compartments 24 can be closed. To this end, each of the compartments 24 has an opening 38 located at the front of the compartment that enables the respective arms 28 to extend outside of the associated compartment 24 in the extended support position of the arm 28 when the compartment door 26 is closed.

Figures 3A, 3B:
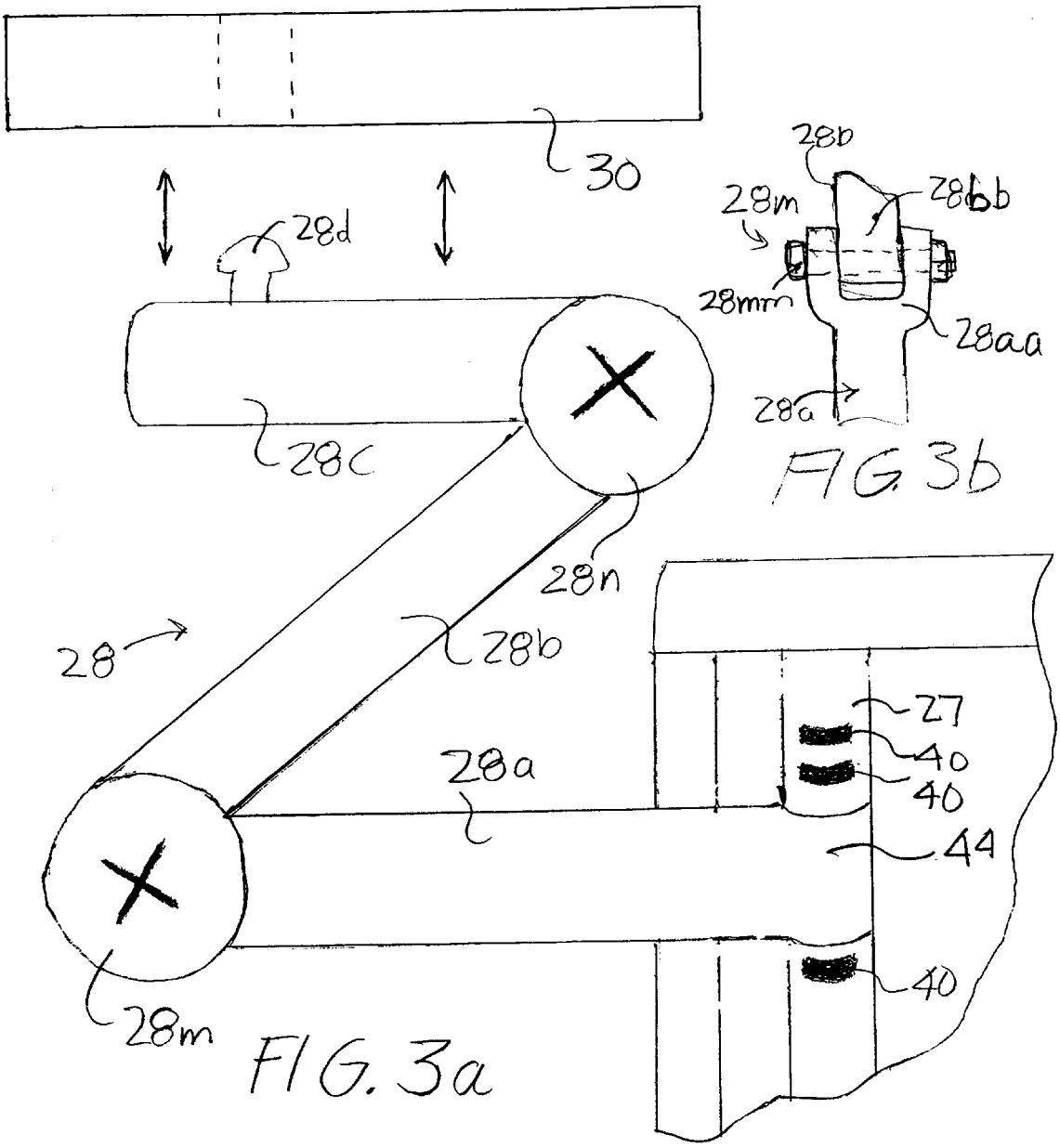
FIG. 3*a* is a side elevational view of the multi-link arm.
FIG. 3*b* is a front elevational view of one of the pivot joints of FIG. 3*a*.

Turning to FIGS. 3*a* and 3*b*, further details of the multi-link arm 28 are shown. As illustrated, the multi-link arm 28 is comprised of three links 28*a*, 28*b* and 28*c* and two joints 28*m* and 28*n*. The first link 28*a* is rotatable about the support member 27, and, as indicated above, can be adjusted for vertical movement along the support member 27. The second link 28*b* is pivotably connected to the first link and to a third link. The third link is pivotably connected to the second link 28*b* and has a free end opposite the pivoted end. The free end of link 28*c* has an anchor element 28*d* located thereon for securing the keyboard support frame 80 to the arm 28. Anchor element 28*d* is of a mushroom shape, as illustrated, and is adapted to engage in a corresponding slot or opening in support frame 30 as is described in more detail below. The first adjustable joint 28*m* pivotably connects the first and second links 28*a* and 28*b* and the second adjustable joint 28*n* pivotably connects the second and third links 28*b* and 28*c*. As shown in FIG. 3*b* for pivot joint 28*m*, each of the joints 28*m* and 28*n* comprises a yoke 28*a*a at the end of one link (link 28*a* in FIG. 3*b*) and a rod end 28*bb* at the end of the other link (link 28*b* in FIG. 3*b*). The rod end 28*bb* is received in the yoke 28*aa* and the yoke 28*aa* and rod end 28*bb* can be secured together in fixed relation by using a suitable tightener 28*mm*, which fixes the position of the two links as a whole. In the embodiment, illustrated adjustment element 28*mm* comprises a simple conventional nut and bolt combination which can be released or tightened by hand using a simple winged turning knob (not shown) although it will be understood that other conventional but more sophisticated pivot joints, which can be set at a desired angle and then fixed, can be employed. It will be appreciated that the adjustable pivot joints 28*m* and 28*n* enable the user to both adjust the horizontal position of the keyboard 30 and further adjust the vertical position thereof.

Figure 4A:
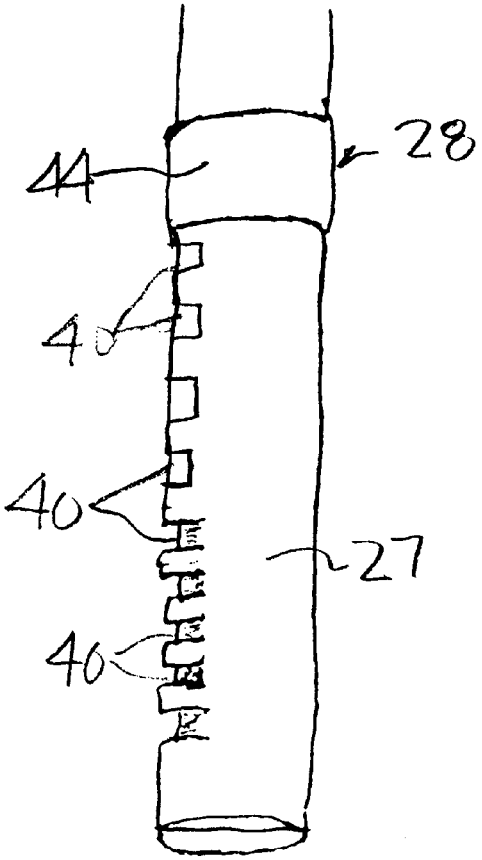
FIG. 4*a* is a rear elevational view of the support member for the multi-link arm of FIG. 3*a*.
Figure 4B:
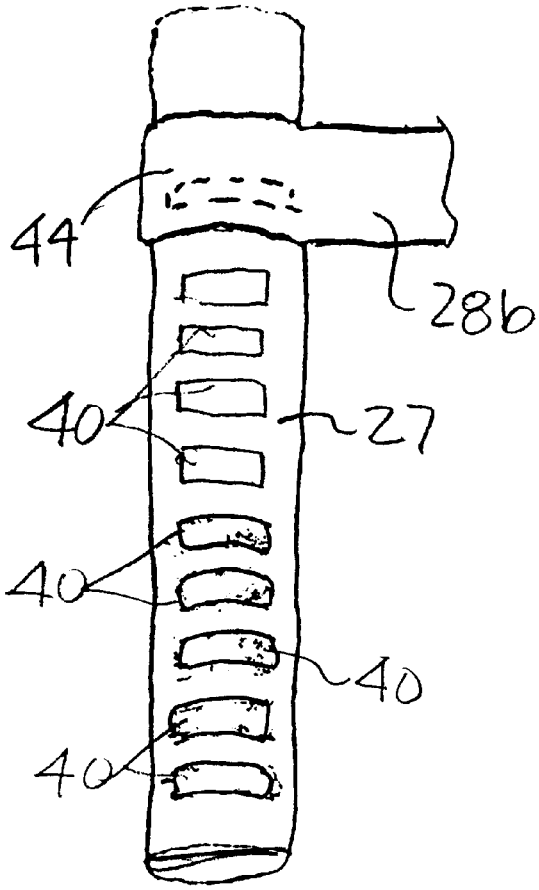
FIG. 4*b* is a side elevational view of the support member.
Figure 4C:
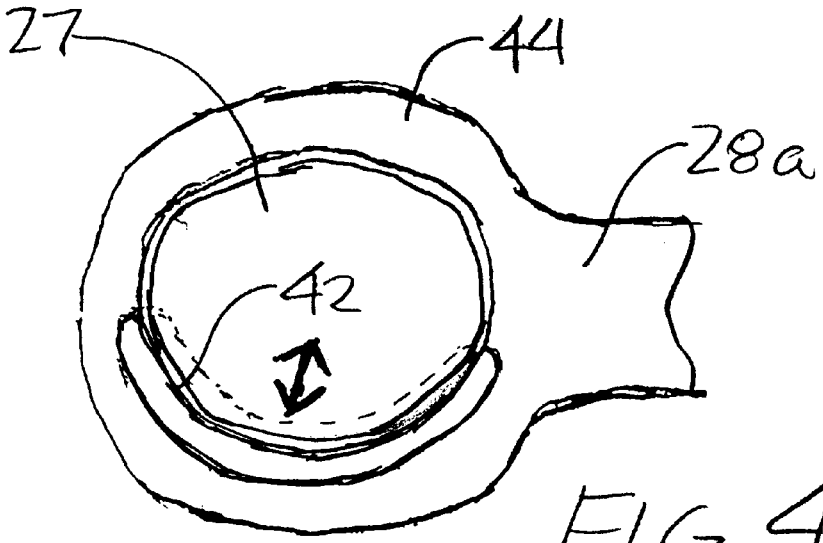
FIG. 4*c* is a top plan view of the anchored end of the multi-link support arm.

Referring to FIGS. 4*a* to 4*c*, the vertical adjustment mechanism for the multi-link arm 28 is shown. As indicated above, the multi-link arm 28 can be moved vertically and fixed in place at a desired height along support member 27. The adjustment mechanism that enables this to be achieved includes a plurality of vertically spaced slots 40 in the vertical support member 27, and a spring element 42 received in a groove in a collar 44 at the proximal end of link 28*a* which is mounted to the support member 27. In operation, the arm 28 is moved along the support member 27 until a desired height therealong is reached at a point where the collar 44 is in registration or alignment with one of the slots 40. The spring element 42 releasably engages the selected slot 40 so as to retain the arm 28 at a vertical height along support member determined by the selected slot 40. Swinging the arm 28 will disengage spring element 42 from the slot 40 because the non-slotted side of member 27 will force the spring element 42 back into collar 44. When a different height is desired, or the multi-link arm 28 is to be rotated for storage within compartment 28, the spring element 40 is caused to disengage from the slot 40 and the arm 28 is moved.

Figure 5A:
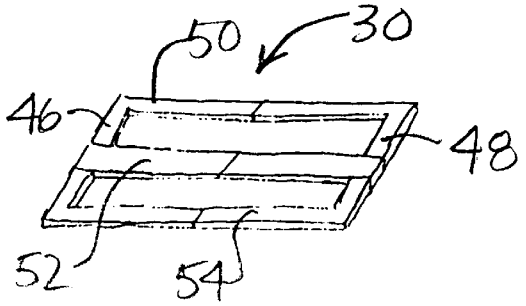
FIG. 5*a* is a top perspective view of the keyboard support frame of FIG. 3*a*.
Figure 5B:
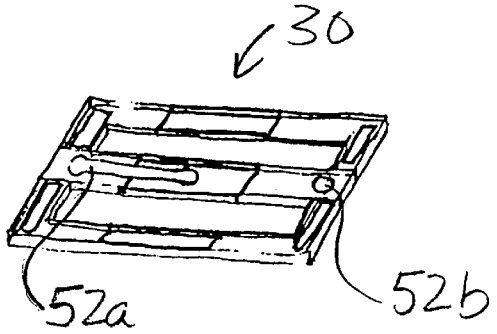
FIG. 5*b* is a bottom perspective view of the keyboard support frame and slots.
Figure 5C:
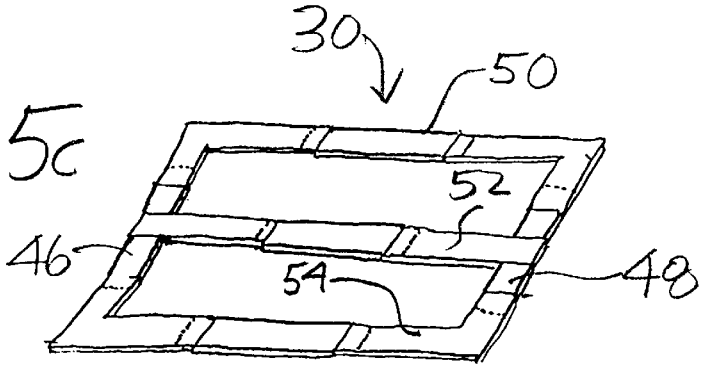
FIG. 5*c* is a top perspective view of the keyboard support frame as adjusted with respect for the length and width thereof.

Turning to FIGS. 5*a* to 5*c*, as illustrated, the length and width of the keyboard support frame can be adjusted using a plurality of sliding rails comprising first and second two parallel sliding rails 46 and 48 that extend along the width of the frame 30, and three parallel sliding rails 50, 52 and 54 that extend along the length of the frame 30 orthogonal to rails 46 and 48. The three parallel rails 50, 52 and 54 include a center rail 52 having first and second spaced openings 52*a* and 52*b* therein. When the keyboard is placed upon the support arms, the openings receive the anchor element 28*d* of each of the respective support arms 28. This anchor and opening arrangement is used to securely hold the keyboard support frame 3*o* on the arms 28. As illustrated, opening 52*a* is an elongated slot which accommodates lengthening of the support frame 30.

When the user desires to leave the chair 10, the frame 30 can be simply disconnected from one of the anchor 28*d*. The keyboard support frame 30 is then swung to one side with ease, enabling the user to conveniently exit the chair. When the user returns to the chair, the anchor 28*d* is easily brought back into place and the support frame 30 resecured.

The rails are a conventional construction such as used in the sliding rails for filing cabinets. Preferably, each of the rails 50, 52 and 54 are of a multiple member construction, wherein rail members are slidable within, and telescope with respect to, a further central rail member to provide expansion and contraction of the rails. Rails 46 and 48 are similarly of a multi-element construction including a central rail member relative to which two further rail members slide. The keyboard support frame preferably includes ball bearings (not shown) for providing a gliding action between the rails. The keyboard support frame also preferably includes means (not shown) for supporting a computer mouse (not shown) at one end thereof.

Figure 6:
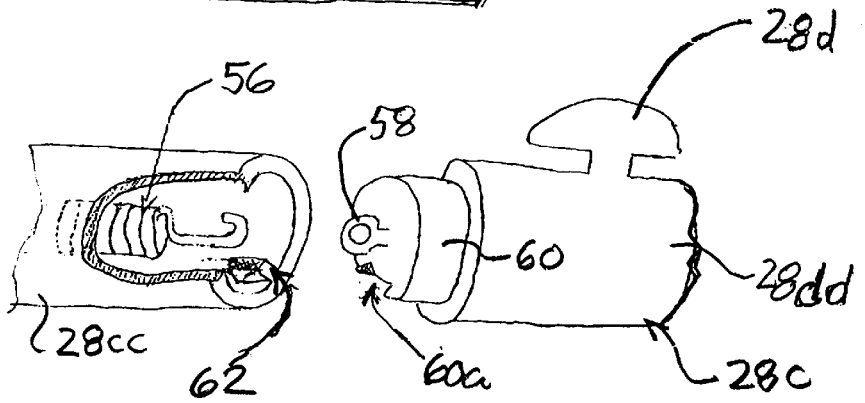
FIG. 6 is a perspective view, partially broken away, of a further embodiment of the multi-link arm.

Referring to FIG. 6, a further preferred embodiment of the invention is shown. In this embodiment, arm 28*c* comprises two arm parts 28*cc* and 28*dd* which are joined together near anchor element 28*b* by a spring 56 secured in place in a hollow end of arm part 28*cc* and connected to an eyelet 58 formed on an end member 60 at the adjacent end of arm part 28*dd*. As illustrated, end member includes an arcuate recess 60*a* in the circumferential edge thereof in which is received a shaped guide member 62 formed in the open or hollow end of arm part 28*cc*. The spring 56 holds parts 28*cc* and 28*dd* together while permitting some limited relative rotation therebetween. The amount of rotation is determined by the angular extent of recess 60*a* and is preferably between 40° to 60°. The purpose of this embodiment is to further accommodate an overweight person in leaving the chair 10. More specifically, because the keyboard will be secured to the keyboard frame 30, a person leaving the chair 10 can simply lift the keyboard support frame 30 from the anchor 28*d* on, e.g., the right side, slide the keyboard and support frame 30 to the left, turn the same through 90° and then rotate arm 28*dd* through, e.g., 40° to 60° and thereby move the keyboard and frame 30 completely out of the way.

Although the invention has been described above in relation to a preferred embodiment thereof, it will be understood by those skilled in the art that variations and modifications can be effected in the preferred embodiment without departing from the scope and spirit of the invention.

What is claimed is:

1. A chair comprising a seat and a pair of armrests, each said armrest including a compartment located therein, each said compartment including a compartment door, a vertical support member disposed in the compartment, and a multi-link extendable support arm rotatable at one end about said support member for movement, when said door is open, between a storage position within said compartment and a support position outside of said compartment, one of said compartments containing a keyboard support frame for, when in use, supporting a computer keyboard and means for storing said support frame within said one compartment when said support frame is not in use, said support arms, when in said support position, being extendable to support said support frame therebetween at a desired location relative to the door.

2. A chair according to claim 1, wherein said storing means comprises at least one support bracket mounted on a wall of said one compartment.

3. A chair according to claim 2, wherein said at least one support bracket is located on an interior side wall of the doors of said one compartment.

4. A chair according to claim 1, wherein each armrest includes hinge means for hingedly mounting the associated door.

5. A chair according to claim 4, wherein said armrests include outer sides and the doors are disposed at said outer sides of said armrests.

6. A chair according to claim 4, wherein said hinge means comprises a hinge disposed at a rear part of the armrest so that the door opens rearwardly away from the front of the chair.

7. A chair according to claim 1, further comprising adjustable means for mounting each of said multi-link support arms for vertical movement along the respective support member so as to permit vertical adjustment of said arms.

8. A chair according to claim 7, wherein said adjustable means comprises a plurality of vertically spaced slots in said vertical support member, and a spring carried by said arm at said one end for releasably engaging a selected one of said slots so as to retain said arm at a vertical height along support member determined by the selected slot engaged thereby.

9. A chair according to claim 7, wherein said multi-link arm comprises a first link rotatable about said support member, and movable vertically therealong, a second link pivotably connected to said first link and a third link pivotably connected to said second link.

10. A chair according to claim 9, further comprising a first adjustable joint for pivotably connecting said first and second links and a second adjustable joint for pivotably connecting said second and third links.

11. A chair according to claim 10, wherein each of said joints comprises a yoke end of one of said links and a rod end of a further of said links received in said yoke end, and tightening means for securing the yoke end and rod end together in fixed relation.

12. A chair according to claim 1, wherein each of the compartments further comprises an opening, located at a front portion thereof, for enabling the respective arm, in the support position thereof, to extend outside of the compartment when the compartment door is closed.

13. A chair according to claim 1, wherein each multi-link arm has a free end opposite said one end and further comprises an anchor element located on the free end of the arm for securing the keyboard support frame to the arm.

14. A chair according to claim 13, wherein said free end of at least one of said multi-link arms comprises two relatively rotatable arm parts for enabling rotation of the keyboard frame when secured to said at least one arm.

15. A chair according to claim 1, wherein the keyboard support frame comprises a plurality of sliding rails for enabling adjustment of the length and width of the keyboard frame.

16. A chair according to claim 15, wherein said sliding rails comprise two parallel sliding rails extending along the width of the frame, and three parallel sliding rails extending along the length of the frame and including a center rail.

17. A chair according to claim 16, wherein the center rail of said three parallel rails has first and second spaced openings therein, for receiving an anchor element of a respective support arm.

18. A chair according to claim 17, wherein one of said openings comprises an elongated slot.

19. A chair according to claim 15, wherein the keyboard support frame further comprises means for supporting a computer mouse at one end of said keyboard support frame.

20. In combination, a chair having seat and arms on opposite sides of said seat, and a support assembly for a computer keypad, said arms of said chair each including a compartment therein, and said support assembly comprising, disposed in each said compartment, a vertically extending support member, and an adjustable support device movable along said support member and rotatable about said support member between a support position outside of the compartment and a stored position within said compartment, each said adjustable support device including a first link mounted on said vertical supporting member for vertical movement therealong and for rotational movement around said vertical support member, a second link pivotally connected to said first link, and third link pivotally connected to said second link and carrying a support element thereon, and said support assembly further comprising an adjustable support frame, adapted to be engaged with the support element of each said adjustable support device, for supporting a computer keypad.

* * * * *